US005181955A

United States Patent [19]

Asteljoki et al.

[11] Patent Number: 5,181,955

[45] Date of Patent: Jan. 26, 1993

[54] METHOD AND APPARATUS FOR HEATING AND SMELTING PULVEROUS SOLIDS AND FOR VOLATILIZING THE VOLATILE INGREDIENTS THEREOF IN A SUSPENSION SMELTING FURNACE

[75] Inventors: Jussi A. Asteljoki, Espoo; Jukka F. Laulumaa, Ulvila; Launo L. Lilja, Pori, all of Finland

[73] Assignee: Outokumpu Research Oy, Pori, Finland

[21] Appl. No.: 826,119

[22] Filed: Jan. 27, 1992

[30] Foreign Application Priority Data

Feb. 13, 1991 [FI] Finland ..... 910690

[51] Int. Cl.[5] ..... C22D 7/00

[52] U.S. Cl. ..... 75/443

[58] Field of Search ..... 75/443

[56] References Cited

U.S. PATENT DOCUMENTS

| | | | |
|---|---|---|---|
| 2,321,310 | 6/1943 | Moore | 75/443 |
| 3,894,864 | 7/1975 | Langhammer | 75/489 |
| 3,897,243 | 7/1975 | Langhammer | 75/581 |

OTHER PUBLICATIONS

Monnot G. et al., Principles of Turbulent Fired Heat; Editions Technip, Paris, 1985, pp. 118-119, 134.

*Primary Examiner*—Peter D. Rosenberg

*Attorney, Agent, or Firm*—McAulay Fisher Nissen Goldberg & Kiel

[57] ABSTRACT

The invention relates to a method and apparatus for raising the temperature and mixing efficiency of mainly non-combustible pulverous solid particles so high, that a desired smelting and volatilizing is achieved. The method is characterized in that the heating and mixing are carried out in at least two stages. Advantageously the reactions are made to happen in a suspension smelting furnace, such as a flash smelting furnace.

20 Claims, 3 Drawing Sheets

METHOD AND APPARATUS FOR HEATING AND SMELTING PULVEROUS SOLIDS AND FOR VOLATILIZING THE VOLATILE INGREDIENTS THEREOF IN A SUSPENSION SMELTING FURNACE

The invention relates to a method and apparatus for raising the temperature and mixing efficiency of mainly non-combustible pulverous solid particles so high that the desired smelting and volatilizing is achieved. The method is characterized in that the heating and mixing are carried out in at least two stages. Advantageously the reactions are made to take place in a suspension smelting furnace such as a flash smelting furnace.

The smelting of a material with a significant heat content, such as a sulphidic concentrate, in a flash smelting furnace partly in two stages is described for instance in the DE patent publication 34 05 462. In this method, concentrate and oxygen-enriched air are fed normally through the top part of the reaction shaft, and they form a suspension; as a result of the exothermic reactions taking place in the suspension, the volatile components of the concentrate are volatilized and discharged through the uptake shaft. In the settler there is created a molten slag layer and a matte layer, which layers contain the major part of the iron and valuable metal content of the concentrate. Part of the suspension-forming particles, however, is discharged to the uptake shaft along with the volatile ingredients and forms flue dust.

In order to decrease the amount of the said dust, in the method of the said DE publication, additional gas is fed tangentially to the bottom part of the reaction shaft; owing to the effect of this gas, the molten drops formed in the suspension are thrown against the walls of the reaction shaft, where they flow downwards and are thus not seized along with the gas flow. The purpose of gas lances arranged in the bottom part of the reaction shaft is thus to reduce the amount of flue dust.

From the U.S. Pat. No. 3,759,501, there is known a cyclone smelting method for copper-bearing materials. There the major part of the copper concentrate is conducted, together with oxygen, tangentially from the cyclone walls into the cyclone, and a small portion is taken from the cyclone arch. The burning of the concentrate also can be enchanced by means of a burner (for example a natural gas burner) directed downwardly from the middle section of the arch. In similar a fashion as in previous embodiment, this also is meant for material which has some heat content of its own, and is homogeneous, having not been agglomerated in the course of drying.

In the prior art there is known the method and apparatus described in the U.S. Pat. Nos. 4,654,077 and 4,732,368 for smelting waste and slags. According to this method, the waste is smelted in a vertical two-part furnace which has a steel structure and is cooled with water. To the upper part of the reactor, there is fed oxygen or oxygen-enriched air and fuel, which burns in this first zone of the reactor. The temperature of the first zone is over 2,000° C. The created flue gases flow down to the next zone, to the top part whereof more oxidizing gas is conducted in order to increase the turbulence. The feed to be smelted is then conducted to this second zone, where the flue gases coming from the top heat the feed, so that the feed is smelted and the valuable metals, such as zinc and lead, are volatilized. The diameter of the lower part of the furnace is larger than that of the upper combustion space, because an increase in the transversal area of the furnace brings about a better mixing of the feed with the hot gases. Both the gases, along with which the volatilized metals flow, and the molten product are discharged through the bottom part of the furnace, and the furnace does not include a settling vessel for homogenizing the melt. Although the furnace consists of two parts, the non-combustible feed is smelted in one stage, the first stage being the fuel burning stage.

As was apparent from the above description, it is customary to perform the rapid raising of the temperature of the solid particles in one stage, because for instance when burning coal, it is important to raise the temperature of the coal particles sufficiently high above the ignition point as rapidly as possible before the supplied energy is attenuated. This is possible because the burning process takes place owing to the heating, heat conduction and ignition only, and the delay time is not too long from the point of view of maintaining the turbulence.

The matter becomes, however, more complicated in a process where the solid particles do not have a heat content of their own, as is the case with sulphide and carbon particles. For instance the reactions of solid particles of waste slags do not produce heat, but all necessary energy must be brought in the form of external fuel. Thus these reactions are endothermic. Moreover, these particles often are agglomerated of even several small particles, and therefore porous. It is attempted to limit the size of these particles, mainly created during drying, so that they remain well under 0.5 mm, mainly in the class of less than 100 μm. Even this porosity increases the required delay time, i.e. heating time. Most decisive, however, is the fact that both the smelting and distribution of volatile ingredients take essentially more time than mere heating, which does not even take place during distribution.

Thus the smelting and volatilizing process of porous particles is most advantageously carried out in several, at least two stages. Among the advantages of a multistage process, let us mention the following: In a commercial furnaces and with large capacities (>20−30 t/h), the required delay time necessary for the reactions is not achieved in an adequately easy fashion without immoderately raising the temperatures.

The above described one-stage condition should consequently lead to the heating of the top end of the reaction space, i.e. the reaction shaft, which should again lead to an uneven heat load and therefore an increase in heat losses.

The procedure with two or more stages also has the advantage that more mixing energy, which is rather rapidly attenuated in suspension, can be brought in during the second temperature-raising stage.

The present invention relates to a method whereby the temperature and mixing efficiency of a mainly non-combustible pulverous solid is raised so high that the desired smelting and volatilizing is achieved, and at the same time the formation of flue dust is as slight as possible. The method is characterized in that the heating and mixing are carried out in at least two different stages. The apparatus of the invention comprises a distributor, arranged in the arch of the reaction shaft of a flash smelting furnace; burners arranged around the said distributor; and a second series of burners located lower than the first. The shape of the flame from the burners located at different points also is important in the embodiment. The essential novel features of the invention are apparent from the appended patent claims.

For reasons of symmetry (the reaction shaft in the flash smelting furnace is a cylinder) it is advantageous to feed and distribute the pulverous solid material to be smelted into the furnace in the middle of the furnace arch, and to disperse it onto a mechanically suitable, sideways dispersing body which is conical or of some other shape. In similar fashion, it is advantageous to distribute it in a loose suspension and, if necessary, apply some distribution air—an amount which is as small as possible but still effective.

The U.S. patent publication No. 4,210,315 describes a central jet distributor with a parabloid-shape dispersing surface; the distributor is as effective as possible both for dispersing and distribution. The best possible result from the point of view of heat transfer is achieved with a powder as small-grained as possible.

The process for which the present method and apparatus are developed sets certain restrictions:

Because all of the heat required by the process is brought in by external energy, the degree of utilization of the combustion heat must be high.

The heat load must be evenly distributed in the furnace.

The amount of dust discharged from the furnace must be as small as possible, because in a process of this type, flue dust cannot be recirculated, but the dusts go to the next process stage where volatilized valuable metals are recovered from the dust. All dust discharged from the furnace increases further treatment and makes it more troublesome. Here the term dust means mechanical dust which is not evoporated and thereafter condensated in the furnace spaces. Instead of the concept chemical dust we have used the term volatilized ingredients, to denote such ingredients that have been evaporated in the furnace, condensed thereafter and recovered in a waste heat boiler or with an electrofilter.

The method and apparatus of the invention are further described with reference to the appended drawings.

Figure 1:
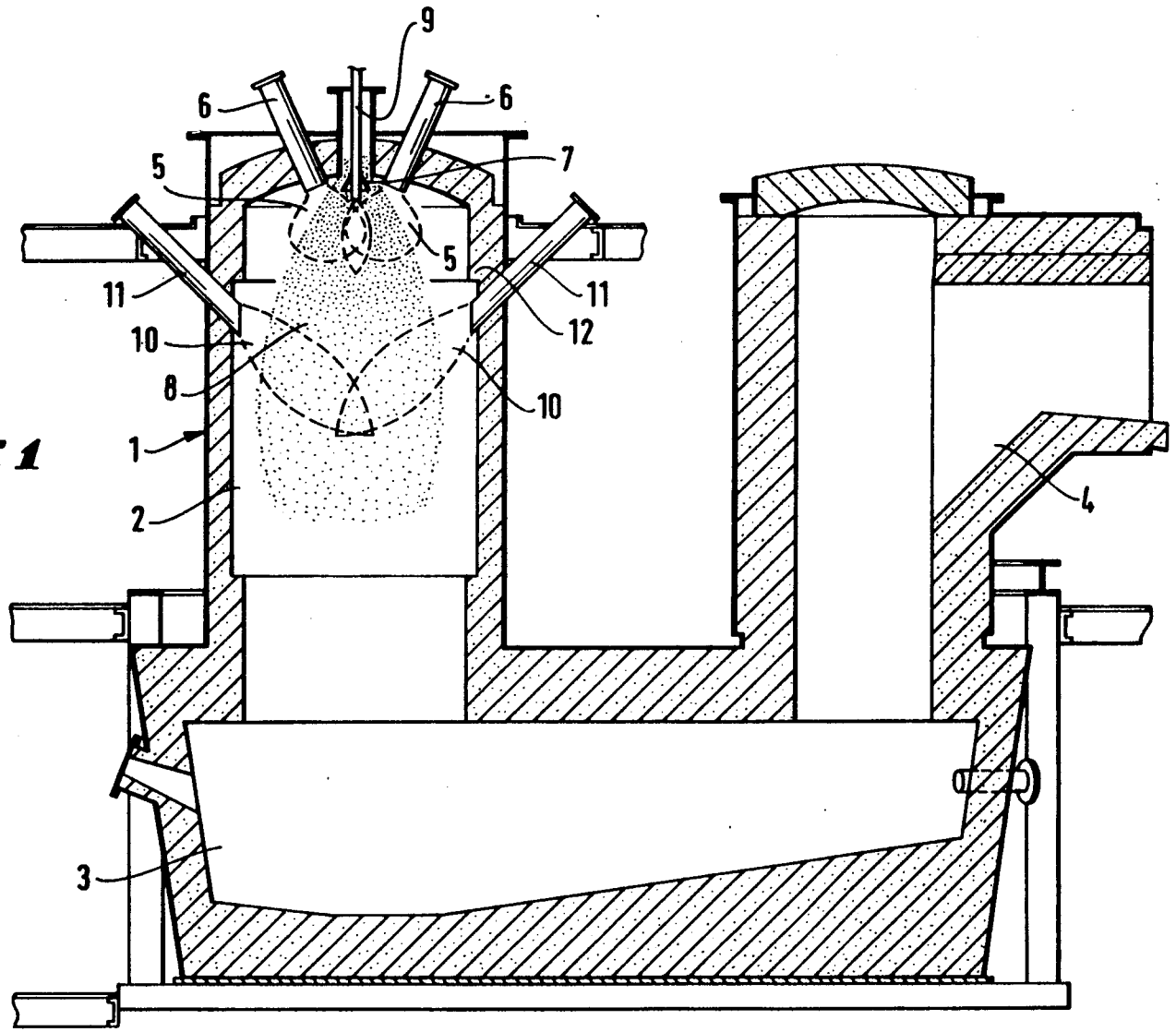
FIG. 1 is a drawing in principle of an apparatus of the invention.

According to the present invention, the particles are prepared as follows:

A brick lined flash smelting furnace 1 provided with cooling plates comprises a reaction shaft 2, a settler 3 and an uptake shaft 4. In the upper part of the reaction shaft 2, there is created an atmosphere with a temperature of about 1,500° C., by burning some mainly gaseous fuel such as natural gas, butane or other corresponding gas, by means of oxygen or oxygen-enriched air. The oxygen-gas burners 6 creating the flame 5 are advantageously located on the arch of the reaction shaft, symmetrically arranged around a special-structure distributor 7, through which distributor the non-combustible powderous solid to be heated is fed in. The burners are placed as near to the distributor as is possible in the circumstances. Owing to their location, the burners 6 are called top burners, and it is essential for them that the flame must be short and wide. The number of top burners is at least three, advantageously 3–6, depending on the size of the furnace.

Into the flame area, created when the fuel and oxygen coming from the burners are ignited, there is dispersed and distributed the slightly porous powder, often agglomerated in the course of drying, as a suspension film 8 as thin as possible, advantageously in an umbrella-like, fashion as is described for instance in the U.S. Pat. No. 4,210,315. Because one of the above enlisted special restrictions was the amount of flue dust discharged from the furnace, the advantages mentioned in the said patent cannot be used as such, but only sufficient dispersion and distribution will be available. This is caused advantageously by means of a straight cone with a relatively small angle; at the terminal edge of the bottom part of the cone, there are drilled small holes for distribution air jets. By means of the size and number of these holes, it is easy for somebody familiar with the art to measure the required distributor structure on the basis of the powder composition. The apex angle of the distribution cone is advantageously within the region of 30°–60°.

The use of the conical dispersion surface is in this case advantageous because the dispersed and distributed powder tends to be classified when spreading away from the cone, so that the coarsest particles fly further than the rest. Consequently, the particles that are most difficult to react, are located on the outer circumference of the umbrella-like suspension. While they require more time (heat, mixing, velocity difference), they protect (shade) the more finely divided particles inside the suspension, and prevent them from obtaining heat, but at the same time they also partly prevent them from proceeding out of the furnace through the uptake shaft together with the gas.

The above mentioned heat demand of the particles located inside the suspension is, according to the invention, satisfied by means of an oxygen-gas burner 9 arranged in the middle of the distribution cone 7. In comparison to the gas burners proper, the capacity of this burner is small, but sufficient in order to balance out the heat and also the need for mixing in the middle section of the suspension. On the basis of its location, this gas burner 9 is called a medium burner. The flame of the medium burner is mainly elongate, and about 5–15% of the total heat amount required is brought in by this burner.

The created powder-gas suspension rather quickly loses its turbulence, in which case heat transfer is not effective anymore. It is true that heating and distribution at this stage have already proceeded to a certain degree, but not far enough, wherefore a new flame front is needed. This flame front 10 is formed by means of oxygen-gas burners 11, arranged symmetrically on the walls of the reaction shaft, with special attention to the flow currents; these burners create long, hot flames, that radially penetrate far enough into the suspension. Because of their location, these burners are called side burners. The number of side burners is at least three, advantageously 4–8, and they are located in the topmost third of the reaction shaft, when seen in the vertical direction.

It is well known in the prior art that in high-temperature suspension furnaces, the burners in the reaction shaft do normally not endure without wearing or blocking. According to one preferred embodiment of the invention, there is therefore constructed a shoulder 12 for the furnace arch, which means that the outer circumference can be dropped lower than the middle part, or the furnace may be narrowed at the top. As an advantage of the shoulder construction, let us mention that when the side burners are located therebelow, it protects the side burners from melt drips. In certain cases the side burner also can be located in the ceiling construction of the shoulder. It is not the purpose of the shoulder to bring the suspension into a more intensive turbulent motion, as was described in connection with the state-of-the-art embodiment, but the purpose is either to allow for the location of the side burners on the arch, or to serve as a protection against melt drips, as was maintained above. The shoulder is so small that it has no effect to furnace flows. The side burner series can also be arranged one below the other.

As was mentioned above, owing to the shape of the distributor, the flowing of the smallest elements of the solid particles to the flue dusts along with the gas can be prevented, because these small elements remain in the middle of the suspension. Another factor is the drying of the feed, so that a controlled agglomeration is achieved, because the creation of dust is decreased by increasing the grain size.

In the above description it was pointed out that the burners are advantageously oxygen-gas burners. It is obvious that instead of the gas serving as fuel, also liquid or solid pulverous fuel can be used when necessary.

A high degree of utilization for the fuel used in the process is achieved, because when applying the method of the invention, first of all the kinetic energy of the solid particles is made use of, and secondly the heat obtained from the flame is completely consumed. This means that the two-phase method and apparatus uses the heat fed in the process more fully than the one-stage process. Should all of the heat require in the process be supplied in one stage, part of it would be wasted due to the reasons mentioned above, and what is more, an essentially greater part would be wasted in heat losses than is the case with the two-stage process. A high degree of utilization also is enhanced by choosing the right types of burners for each application.

Factors affecting the heating of waste material are also described with reference to the example below.

EXAMPLE 1

The example describes the decomposition and smelting of agglomerates created of jarosite particles.

The total reaction of the decomposition of pure jarosite in a reductible atmosphere can be written for instance as follows:

$$NH_4FE_3(SO_4)_2(OH)_6+CO=\tfrac{1}{2}N_2+5H_2O+2\text{-}SO_2+CO_2+Fe_3O_4$$

The described total reaction, however, happens in several different stages, i.e. as a chain of successive partial reactions that take place at different temperatures. This chain of reactions is examined for example by means of DTA equipment (DTA=differential thermal analysis), which reveals the heat behaviour of a material. An example of the DTA curve of jarosite is illustrated in FIG. 2.

Figure 2:
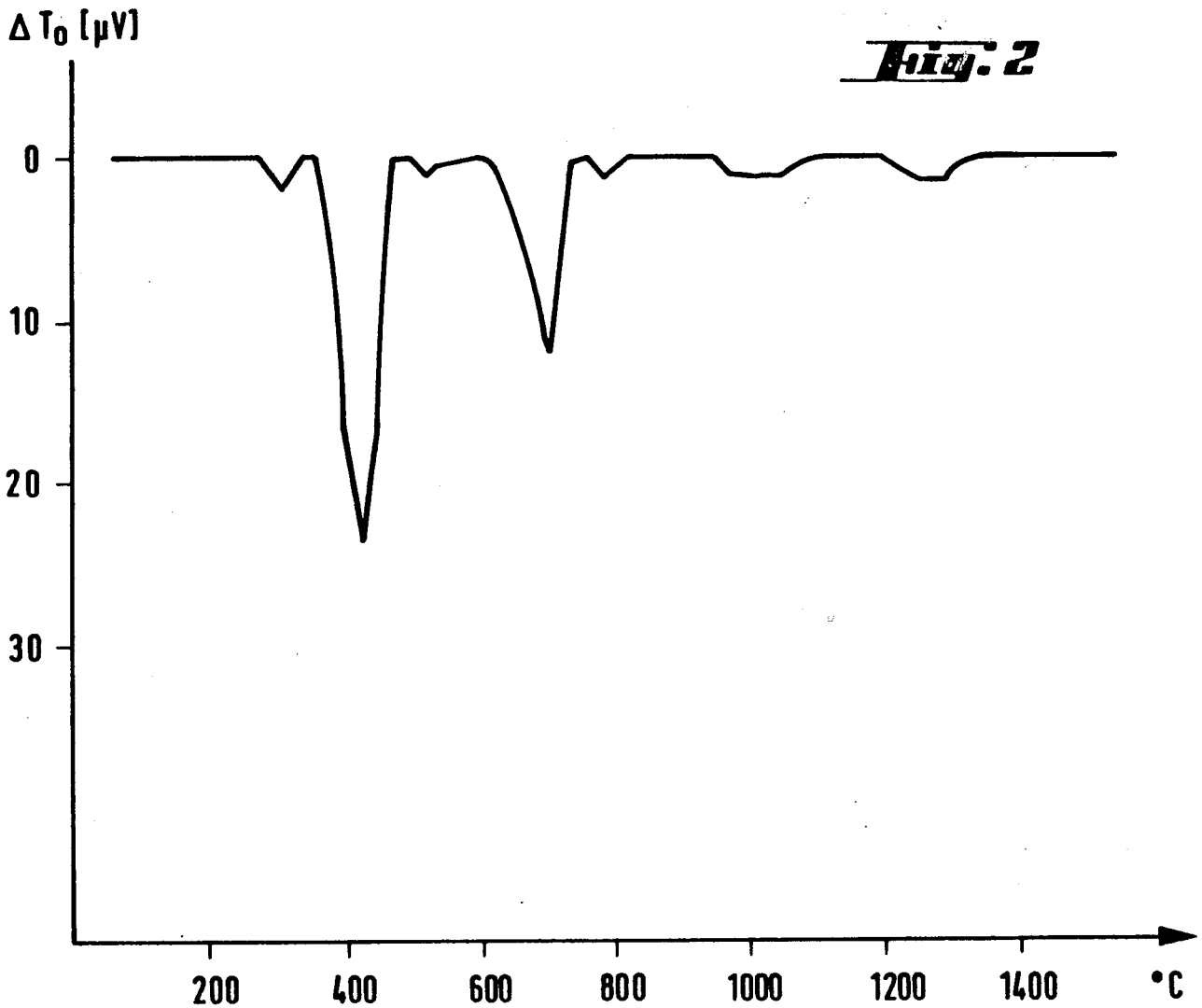
FIG. 2 is a DTA curve of the heating of a waste material.

In FIG. 2, there is illustrated, on the vertical axis, a scale describing the temperature difference of the jarosite sample and an inert reference sample, and on the horizontal axis the temperature of the furnace equipment, which also is the temperature of the samples. The temperature differences of the samples are shown in the curve as downwardly pointing peaks, and in this case they mean that the reactions are endothermic, i.e. energy consuming. The peaks appear at temperatures typical for each partial reaction, and the size of the peaks is comparable to the heat amount consumed by the reactions.

The following reactions are most likely connected to the most remarkable absorption peaks:

1. At the average temperature of about 435° C., jarosite is decomposed, producing water, ammonia and sulphur oxides, into iron sulphates—either to $Fe_2(SO_4)_3$ or to $FeSO_4$.

2. At the temperature of about 720° C., iron sulphates are decomposed to sulphur oxides and to hematite $Fe_2O_3$.

3. At about 1,015° C. it is probable that the reduction of hematite into magnetite $Fe_3O_4$ takes place, as well as the heat absorption connected to the decomposition of gypsum contained in the jarosite as impurity.

4. At about 1,300° C., the sample is smelted.

Figure 3:
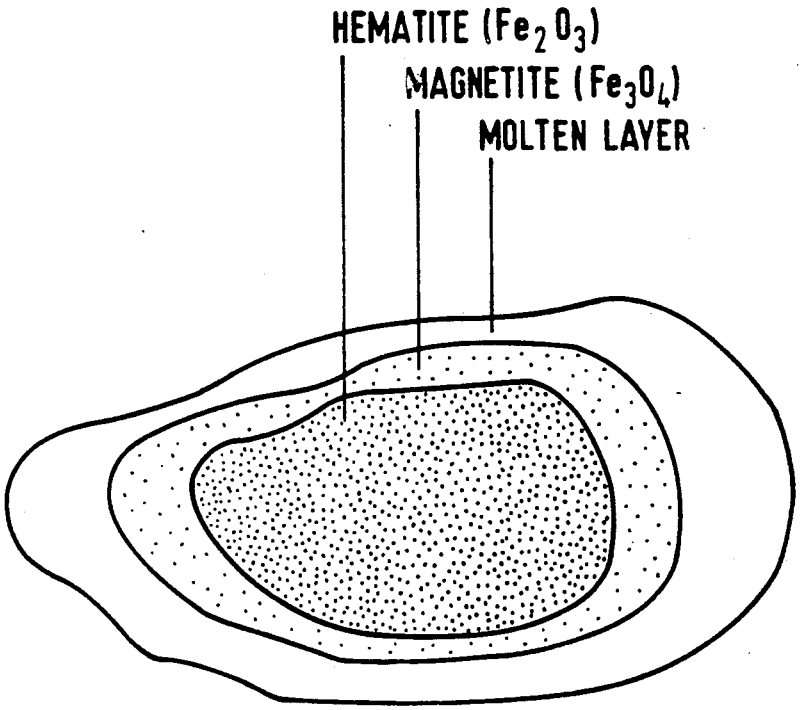
FIG. 3 illustrates the reaction mechanism of the waste material of curve 2.

In a pilot test, samples were taken from the reaction shaft with a special device. In certain process conditions, in sample agglomerates of a certain size, there were observed products of the above described reactions 2, 3 and 4. FIG. 3 shows a schematical illustration of the structure of such an agglomerate. First the agglomerate was composed of nested layers, in the composition whereof typical compounds were represented as follows:

innermost mainly hematite on top of that, a layer rich in magnetite outermost a molten layer composed of iron oxides and impurity silicates.

There is another formulation for jarosite in which the total reaction of the decomposition of pure jarosite can be written, for instance, as follows:

$$KFe_3(SO_4)_2(OH)_6+CO=3H_2O+F_3O_4+CO_2+\text{-}2SO_2+KO_2.$$

We claim:

1. A method for raising the temperature and mixing efficiency of substantially non-combustible pulverous solid particles in a suspension melting furnace, such that smelting and volatilizing is achieved, wherein:

at a first stage of heating, a mixture of oxygen or oxygen-enriched air and a fuel is supplied from at least three different burners and is made to discharge downwardly from an arch of a reaction shaft;

said mixture, when ignited, creates a short and wide flame to which flame a pulverous, substantially non-combustible solid is fed through a distributor member located in a middle area of the burners; and said solid material is dispersed to flow down in an umbrella-like fashion; and at a second stage of the heating, in an upper part of said reaction shaft there is arranged, symmetrically in relation to the flows, yet at least one series of burners, and the oxygen-fuel suspension fed through said one series of burners burns with a long, hot flame and smelts the suspension; and the molten drops fall into a settler, and the gases and volatilized ingredients are discharged through an uptake shaft.

2. The method of claim 1, wherein said burner series is placed in a vertical direction in an uppermost third of said reaction shaft.

3. The method of claim 1, wherein the number of the burners having a long flame is at least three.

4. The method of claim 1, wherein in order to heat the innermost parts of the solid suspension, an oxygen-fuel burner is directed downwardly from the arch of said reaction shaft, from inside of said distributor, and the flame created by said oxygen-fuel burner is elongate in form.

5. The method of claim 1, wherein the pulverous solid is at least partly agglomerated.

6. An apparatus for heating pulverous, mainly non-combustible solid matter in a suspension melting furnace for achieving smelting and volatilizing, wherein:

on an arch of a reaction shaft (2) at least three top burners (6) are arranged symmetrically in relation to each other, said three top burners (6) having a flame (5) which is short and wide;

a distributor (7) arranged in the middle of said top burners for feeding pulverous solids into the flame;

at least one series of burners (9) arranged in an upper part of said reaction shaft and said at least one series of burners (9) being symmetrical in relation to the flows and directed radially with respect to the reaction shaft;

said flame created by said one series of burners (9) being long and penetrating whereby the molten drops created in said reaction shaft (2) are made to fall into a settler (3) and the gases and volatilized ingredients are made to flow to further treatment through an uptake shaft (4).

7. The apparatus of claim 6, wherein the reaction shaft (2) is provided with a shoulder (12).

8. The apparatus of claim 6, wherein the side burners (9) are located on a wall of said reaction shaft (2), underneath a shoulder (12).

9. The apparatus of claim 6, wherein said side burners (9) are located in a ceiling construction of said shoulder (12).

10. The apparatus of claim 6, wherein the side burners (9) are located in an uppermost third of said reaction shaft (2), when seen in a vertical direction thereof.

11. The apparatus of claim 6, wherein the distributor (7) is a cone distributor.

12. The apparatus of claim 6, wherein the apex angle of the cone distributor is between 30°-60°.

13. The apparatus of claim 6, wherein in the middle of the cone distributor (7), there is arranged a middle burner (9).

14. The method of claim 2, wherein the number of the burners with a long flame is at least three.

15. The apparatus of claim 7, wherein said side burners (9) are located on a wall of the reaction shaft (2), underneath said shoulder (12).

16. The apparatus of claim 7, wherein said side burners (9) are located in a ceiling construction of said shoulder (12).

17. The apparatus of claim 11, wherein the apex angle of the cone distributor is advantageously between 30°-60°.

18. The apparatus of claim 17, wherein said side burners (9) are located in a ceiling construction of said shoulder (12).

19. The apparatus of claim 18, wherein the distributor (7) is a cone distributor.

20. The apparatus of claim 19, wherein said side burners (9) are located in the uppermost third of the reaction shaft (2), when seen in the vertical direction thereof.

* * * * *